United States Patent [19]

Kimmel

[11] 4,132,484

[45] Jan. 2, 1979

[54] MIXER, PARTICULARLY HEATING-COOLING MIXER FOR CHEMICAL PROCESSES

[76] Inventor: Hans Kimmel, Bielefelder Strasse 445A, 493 Detmold 18, Germany

[21] Appl. No.: 753,874

[22] Filed: Dec. 23, 1976

Related U.S. Application Data

[63] Continuation-in-part of Ser. No. 580,285, May 23, 1975.

[30] Foreign Application Priority Data

Dec. 30, 1975 [DE] Fed. Rep. of Germany ..... 2559175
Dec. 30, 1975 [DE] Fed. Rep. of Germany ..... 2559176
Jun. 11, 1974 [DE] Fed. Rep. of Germany ..... 2428153

[51] Int. Cl.[2] ..... B01F 7/30
[52] U.S. Cl. ..... 366/288; 366/295; 366/312
[58] Field of Search ..... 259/102, 84, 85, 64, 259/5, 21, 40; 366/288, 295, 312

[56] References Cited

U.S. PATENT DOCUMENTS

| | | | |
|---|---|---|---|
| 364,622 | 6/1887 | Zies | 259/102 |
| 576,296 | 2/1897 | Ball | 259/102 |
| 1,200,250 | 10/1916 | Larsen | 259/102 |
| 1,415,735 | 5/1922 | Trust | 259/102 |
| 2,244,765 | 6/1941 | Christensen | 259/102 |
| 3,482,823 | 12/1969 | Rechtin | 259/102 |

*Primary Examiner*—Robert W. Jenkins
*Attorney, Agent, or Firm*—Strauch, Nolan, Neale, Nies & Kurz

[57] ABSTRACT

A mixer is described having at least one mixing element which rotates relative to a mixing container axis. The mixing element comprises a plurality of vertical rods held by a revolving plate. The velocity and the direction of rotation of the mixing element about the container axis and the rotation of the element about its own axis are such that particles of mix material contacting the mixing element have at all points the same contact velocity.

5 Claims, 14 Drawing Figures

7
Vp
VMa
8a
ω
Vr
D
2
e
R
P
0

7
Vp
VMb
8b
ω
Vr
d
e
R
P
0

7
Vp
VMc
8c
ω
d
Vr
e
R
P
0

Fig. 6
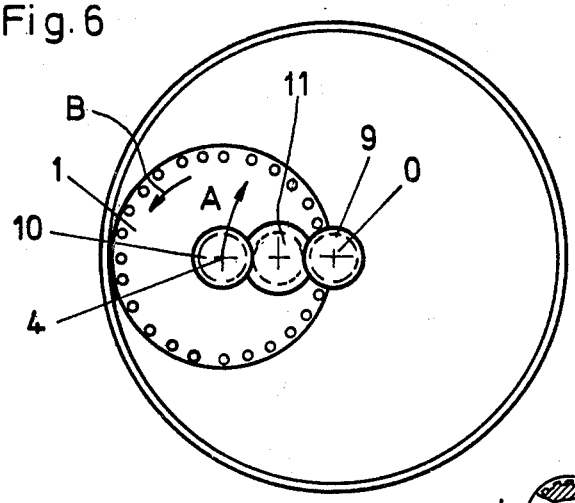
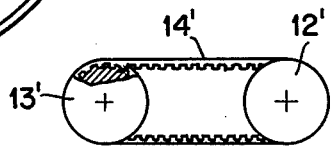
Fig. 10
Fig. 7
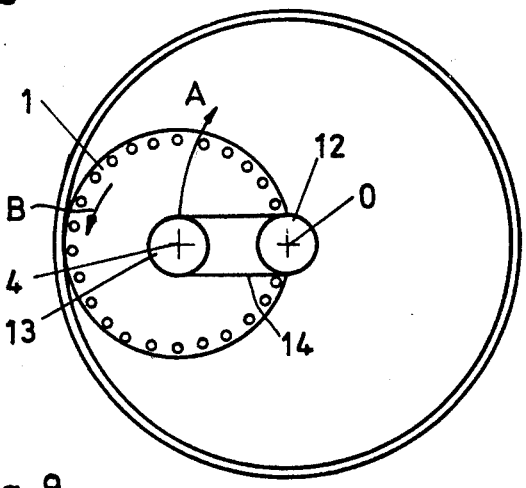
Fig. 9
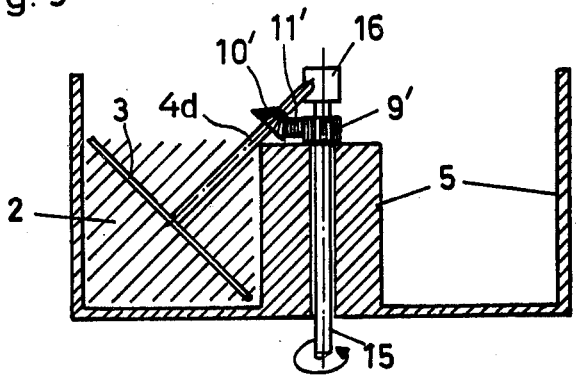

MIXER, PARTICULARLY HEATING-COOLING MIXER FOR CHEMICAL PROCESSES

CROSS-REFERENCE TO RELATED APPLICATION

This application is a continuation-in-part of co-pending application Ser. No. 580,285 filed May 23, 1975.

BACKGROUND OF THE INVENTION

This invention relates to a mixer particularly adapted for heating and cooling for use in chemical process applications. The mixer has a symmetric mixing element which comprises a plurality of mixing rods which are parallel to the mixing container axis and the rotation axis of the mixing element. The mixing element follows a planet-like movement about the container axis; the direction of rotation of the element is opposite to that of the rotation of the element about its own axis. Such a mixer is shown in German Pat. No. 344,764.

The prior art mixer shows a revolving mixing container having two cage-like mixing elements which are rotatably attached to two rigidly mounted arms. A gear rigidly mounted on the container, drives the mixing element via an intermediate gear located on the arm. The direction of movement of the element about its own axis is the same as the direction of movement of the container about the container axis.

Those skilled in the art were previously of the opinion that, in order to achieve particularly good mixing, the speed of revolution of the mixing element should be relatively high in comparison with the speed of revolution of the planet-like movement with which the element moves about the container axis. In the case where such a mixer is used as a heating mixer, where the warming effect is produced by means of friction in the mixing material itself and between the mixing material and the mixing element, the mixer will be limited to its effect by means of the warming of the outer extremity of the mixing element.

The center of the mixing element will remain relatively cool causing a non-uniform heat distribution in the mixing element and in the mix material. This is particularly unacceptable in the case where the warming is to bring about a chemical or physical transformation since this will cause the transformation to be non-uniform.

According to the instant invention, a mixer is disclosed in which a constant mixing pattern is achieved over the total cross-section and over the total longitudinal section of the mix container; that is, on all positions where mixing material contacts the mixing elements, a constant velocity is obtained, thereby causing a uniform warming of the mix material and the mixing element.

In order to accomplish this, the angular velocity must satisfy the condition $\omega_P = \omega_M$ wherein $\omega_P$ is an angle of velocity of the mixing element about the mixing container axis and $\omega_M$ is the angle of velocity of the mixing element about its own axis. If one would watch the movement of the mixing element in the mixing container, it would appear that the mixing element did not revolve at all. Any particular point located on the mixing element describes a circular path about the container axis. This is the reason that the usual propeller or rake is not used as a mixing element, since this could not cover the total container cross-section. The mixing element advantageously comprises a plurality of rods which are preferably regularly distributed about the circumference of an element and are located about the rotational axis of the mixing element.

A mixing element turns about its own axis so often as it is turned about the container axis; no prior art device operates in this fashion. In the case of a revolving container, the container speed of revolution equals the speed of revolution of the mixing element. Up to now, it was not known that, by this means, all particles of mix material throughout the container will contact the rods of the mixing elements at the same speed. In the mixer shown in the afore-mentioned DT-PS No. 344,764, this is not the case, since this mixer has a mixing element which rotates at a much higher speed than the container.

If the mixing element is to be used to actively temper the mixing material, an appropriate apparatus can be provided, e.g. the rods of the mixing elements can contain electric windings or a heating or cooling medium can be circulated through the rods and be connected to an appropriate circulation system. Since the mixing element according to the invention rotates about its own axis only one time for every single planet-like circulation, the driving means for the elements can be of particularly simple construction.

A simple driving connection between the driving axis of the mixing element and the axis of the container will suffice. The axis of the mixing element and the axis of the container can each carry a gear, the gears being connected by a free-running connecting gear and having the same amount of teeth; the connecting gear will be carried by the same means which connects the container axis to the mixing element axis. It is also possible to locate a toothed pulley on each axis, each pulley having the same diameter and being connected by a toothed belt. This belt causes a movement in which the axis of the mixing element does not turn relative to the axis of the container during the planet-like movement of the mixing element about the container axis.

With respect to this embodiment, the difference between the inventive concept and known mixer is particularly clear. As has already been mentioned, there is produced a uniform mix pattern over the total container cross-section. This is an important advantage over the prior art. Another important advantage is that, with the same container dimensions and the same contact velocity the kinetic energy which is released for warming is three-times higher with the mixer of the invention as in the prior art mixers.

Another advantage of this invention is that the mixing element contacts the mixing material equally with all of its surfaces; therefore, there will be no shadow-like build-up of mix material deposits on the mixing element. A disadvantage generally found in the prior art.

Although the main advantage of the invention is seen in the case where one wishes to achieve a uniform warming of the mixing material, the invention can also be utilized in the case where a uniform mix pattern is desired, e.g. in case of mixing volatile liquids where one seeks to disturb the upper surface as little as possible. For the mixing of this type of material, one can utilize a mixer with a mixing element which is inclined with respect to the container axis. The speed of revolution is adjusted so that $\omega_M = \omega_P \cdot \cos \alpha$ where $\alpha$ is the angle between the axis of the element and the container. One would not obtain a uniform mixing pattern in the direction of the container axis; however, one would achieve this in the direction perpendicular to the container axis.

This type of mixer also has an improved mixing pattern with respect to the similar known mixers.

If a more highly viscous mass, for instance a gel or paste, is prepared with such a mixer, this mass only inadequately flows downwards from the container walls, and some of it may become baked on.

According to a further development of the invention, therefore, at least one wall scraper is arranged inside the mixer which rotates around the mixing container axis in the same direction as the mixing element, but with at most half the angular velocity compared to the latter.

These measures ensure that the scraper does not encounter the mixing material at a higher velocity than that of the individual stirring rods of the mixing element. It is expedient to go to the upper limit of what is permissible, i.e. to have the wall scraper rotating about the container axis with half the angular velocity of the mixing element. The scraper, which also creates warmth in the mixing material by means of friction, then has the optimum effect.

Further novel features and other objects of this invention will become apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings, in which:

FIGS. 6 and 7 are schematic showings of embodiments of coupling between the container axis and the mixing element driving axis seen from above;

FIG. 9 is a schematic showing of a mixer having a mixing element axis inclined with respect to the container axis;

FIG. 10 is a diagrammatic representation of a toothed belt and pulley arrangement that may be used in the belt drive of FIGS. 7 and 8;

Figure 1:
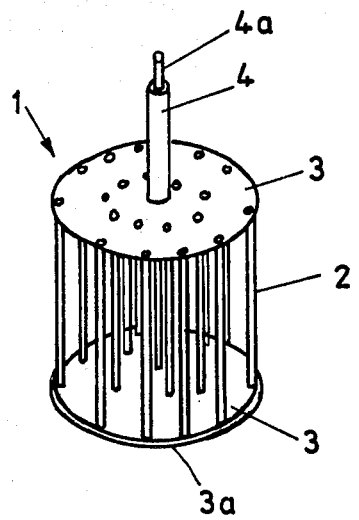
FIG. 1, shows a mixing element for use in the mixer according to the invention.

As mentioned, the mixing element according to the invention cannot be the usual blade, propeller, rake or similar object; it is necessary that the mixing element be relatively uniform about its circumference. Such a mixing element is shown in FIG. 1. This element consists of a plurality of rods 2 located about the axis of the mixing element in a circular uniform pattern. The rods 2 are preferably carried by a single circular plate 3. When the mixing element is removed from the container, the material can drop from the free end of the rods 2. If need be, a second plate 3 can be located at the underside of the rods 2 as is shown in FIG. 1. Such an arrangement has advantages in heat exchange circulation systems. The total system can be connected to a heating-cooling circulation system (not shown). For this purpose, the plates 3 are hollow and build, with the hollow rods a plurality of chambers. The axis 4 would be in this case a double-walled connection to the lower chamber.

Figure 2:
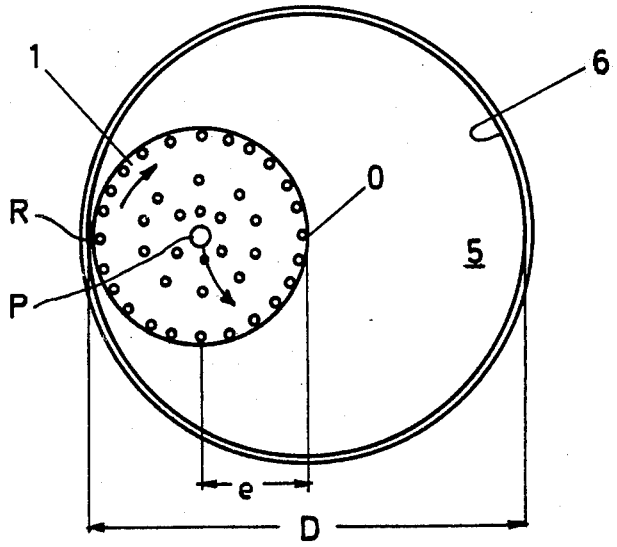
FIG. 2 shows schematically the container and mixer from above.

The Figure shows a piece **4*a* which extends out of shaft 4*b* and the double floor 3*a* on the lower end of the mixing element 1. The double wall construction is not shown in the upper plate. FIG. 2 shows schematically the arrangement of the mixing element 1 and the container 5. A single element 1 is shown in the drawing, however, it should be noted that a second element may be also included diametrically opposite that shown. The diameter of the element of this embodiment is approximately one half of the diameter of the container D. The eccentricity e of the axis P of the mixing element is approximately d/4. The mixing element 1 approaches the axis O of the mixing container 5 as well as the inner wall 6**. This latter at point R.

Figure 3:
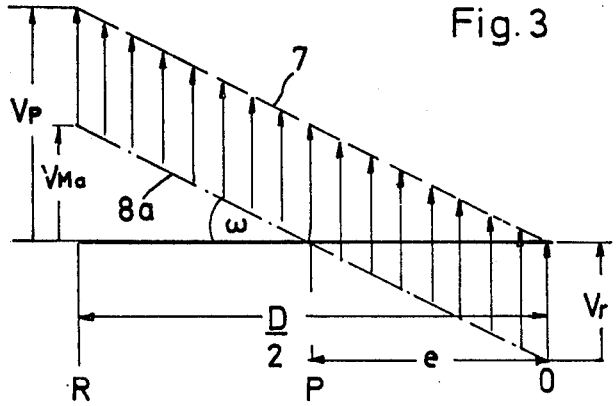
FIGS. 3 through 5 show mixing patterns for various embodiments of mixers having identical container diameters.

The directions of rotation of the planet-like movement of the axis P and the direction of rotation of the mixing element 1 about its axis are shown with the arrows of FIG. 2. FIG. 3 shows a mixing pattern which corresponds to the mixing element of FIG. 2. The broken line 7 is the upper limit of the mixing pattern which is achieved when the mixing element is rotated about the axis O of the container while holding its own axis rigid (or if one were to rotate the container 5 and hold the mixing element 1 stationary). The linear velocity is equal to 0 at middle point 0 and a maximum value $V_P$ at point R, i.e. near the container edge.

A second rotational movement has, as its center, point P which is a distance of D/4 from the container axis O. The angular velocity of this movement is as large as the angular velocity of the planet-like movement and reaches a maximum speed of $V_{Ma}$ which is subtracted from the speed of the velocity caused by the planet-like movement. The rotary motion of the mixing element is shown with the broken line **8*a*. A differential which is constant over the total radius D/2 of the container is shown by means of the arrows between the lines 7 and 8*a***. The resulting speed $V_r$ is equal to the speed with which the axis of the mixing element revolves about the container axis O.

Figure 4:
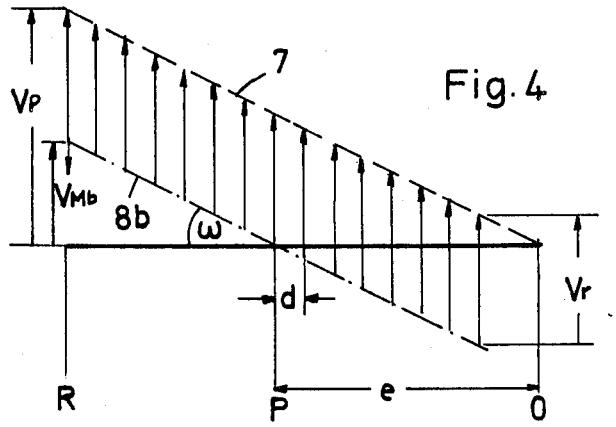

FIG. 4 shows an embodiment in which the diameter of the mixing element is smaller than that of the previous embodiment. This corresponds to the case where the diameter of the container axis is so large that it cannot be ignored; this will occur where the driving means of the mixing elements extend from underneath the container through the container's shaft. The eccentricity of the axis of the mixing element is therefore greater than in the previous examples and, with the same angular velocity, the maximum velocity $V_{Mb}$ on the outer end of the mixing element will be smaller than in the previous examples. The resulting contact velocity is therefore larger than in the case of the previous embodiments; this is seen in FIG. 4 in that the lines 7 and **8*b*** have a greater distance between them.

Figure 5:
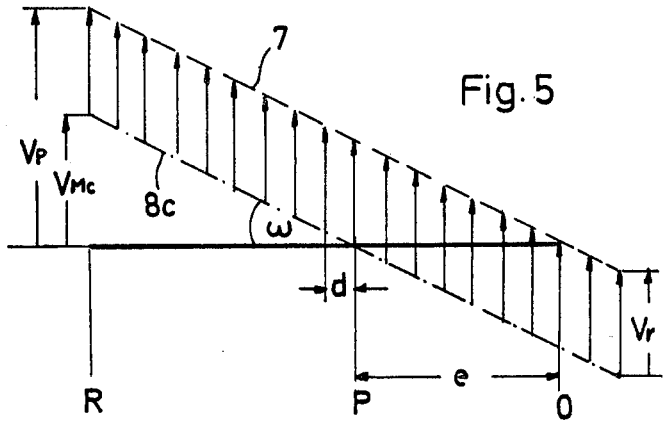

FIG. 5 shows the case of an embodiment in which the eccentricity of the mixing element is smaller than D/4, i.e., the diameter of the mixing element is larger than the radius of the container. The angular velocity of the planet motion and the mixing element rotation are equal and opposite each other. The maximum speed of $V_{Mc}$ at the outer end of the mixing tool is therefore larger than in the first discussed embodiment and the resulting contact speed $V_r$ is smaller than in the previous examples.

FIGS. 3 through 5 show that by following the teachings of this invention one can achieve a constant mixing pattern throughout the container with any eccentricity e of the mixing element. In these Figures, however, one can see that different contact velocities are involved.

FIG. 5 is the least advantageous embodiment since only a single mixing element can be used; in the example of FIG. 3 two may be used. In FIG. 4 more than two mixing elements can be arranged in the container; the FIG. 4 embodiment permits the larger maximum through rate of mix material.

Figure 8:
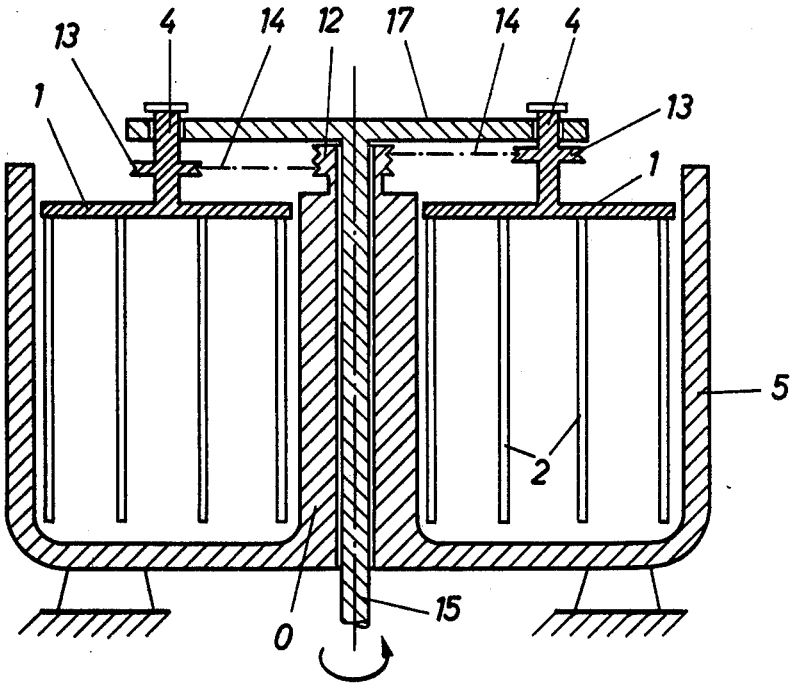
FIG. 8 is a longitudinal section of the FIG. 7 embodiment.

It has already been mentioned that the coupling of the container axis and the driving axis of the mixing elements can be made quite simple. This is shown in FIGS. 6, 7 and 8. FIG. 6 shows a coupling between axis O and driving axis 4 by means of a gear arrangement consisting of a fixed gear 9 and 10 connected respectively to the container axis and the driving axis 4 of the mixing element 1, both gears having the same diameter. The two gears engage gear 11 which is held by a carrier 17' and revolves with the carrier about the axis O.

FIGS. 7 and 8 show a connection between the container axis O and the driving axis 4 by means of pulleys 12 and 13, the pulleys are fixedly mounted on the axes, and have the equal diameters, and are connected by belt 14. A connection between the pulleys 12 and 13 is such as to cause a movement as that of the embodiment of FIG. 6 wherein, during the planet-like movement in the direction A, the mixing element turns in the opposite direction B and has relative to the container axis O no rotational movement.

The longitudinal cross-section according to FIG. 8 shows the pulley drive and the positioning of the mixing tool 1. A shaft 15 passes through axis O which supports pulley 12 having two tracks; cross-piece or carrier 17 is attached to the upper end of the shaft 15 and two bearings, carried by cross-piece 17, hold shafts 4c of the mixing element 1. Pulleys 13 are located on the shafts 4c.

When the shaft 15 is turned as by a drive unit M (a conventional motor or the like) the mixing element will be rotated about the axis O. The pulley belt 14 and the pulleys 12 and 13 operate so that the shafts 4c turn in the bearings of cross-piece 17. The diameter of the pulleys 12 and 13 is such that it would appear to the observer that the mixing elements 1 do not turn about their own axis but, rather, merely revolve about the container axis O. The pulleys 12 and 13 and belt 14 may be toothed as shown respectively as pulleys 12' and 13' and belt 14' in FIG. 10. It is also possible to provide for other types of couplings, e.g. by controlling the various movements by means of synchronized separate driving means. The embodiments of FIGS. 6 and 7 are particularly simple in construction and are therefore particularly advantageous.

The above described concepts can be utilized in other embodiments as e.g. shown in FIG. 9. FIG. 9 shows a mixing element (multiple elements can be used, of course) having an axis inclined with respect to the axis of the container at approximately a 45 degree angle. The mixing element comprises plate 3 which has parallel rods extending from either side of the plate. The length of the individual rods is so that the end of the rods extend to the container floor and side walls without, however, touching them.

The driving connections can be carried out as in the previously described embodiments taking into account, however, the relationship $\omega_M = \omega_P \cdot \cos \alpha$; this can be achieved through e.g. different dimensions for the pulleys or gears. The coupling shown in FIG. 9 corresponds to that of FIG. 6. The same reference numbers have been used for corresponding elements.

The drive is carried out via a shaft 15 which extends through the gear 9'; the shaft 4d is rotatably mounted in the head 16. In order to provide for the oppositely directed rotational movement gear 11' is positioned between gears 9' and 10'.

Figure 11:
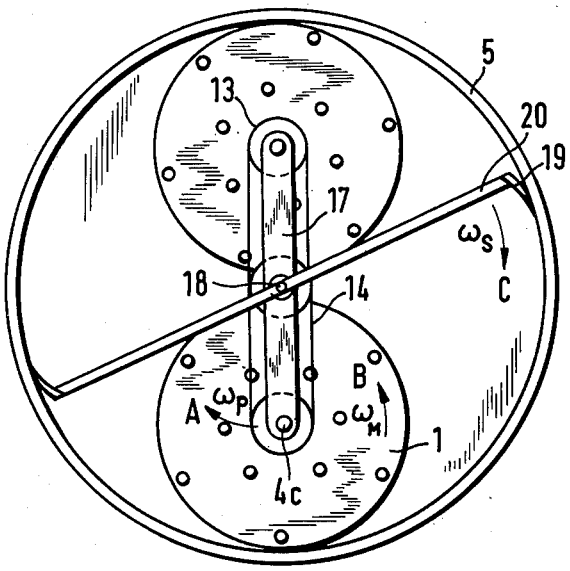
FIG. 11 shows a diagrammatic representation of a mixer equipped with a wall scraper, from above.

According to FIG. 11, the mixer is equipped with a wall scraper 19, which rotates about the mixing container axis in the direction of arrow C, the same direction as the cross-piece 17. The wall scraper 19 is mounted on a cross-piece 20 which is rigidly connected to a shaft 18 which passes through the container. Since the rotary radius of the mixing element 1, i.e. the distance of its axle driving shaft 4c from the container axis, is about half as great as the radius of the inner space of the mixing container 5, the result is that, at an angular velocity of the wall scraper of $\omega_S = 0.5\omega_P$, the impact velocity of mixture particles on the wall scraper 19 is as great as on all the rods of the mixing element 1.

Figure 12:
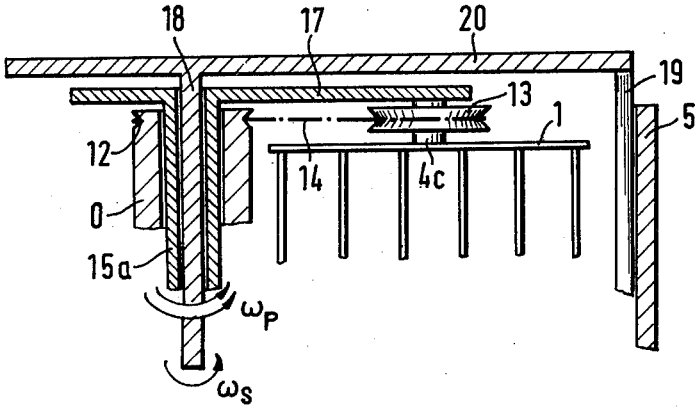
FIG. 12 shows a longitudinal section through a detail of the mixer according to FIG. 11.

FIG. 12 shows a possible embodiment for performing the drives for mixing element 1 and wall scraper 19. At the upper end of a rigid tube O formed as part of the container 3, a belt pulley or drive pulley 12 is constructed. In the tube O a hollow shaft 15a is mounted, at whose upper end a cross-piece 17 is attached. This cross-piece supports the shafts 4 of the mixing elements 1. Connected to each mixing element 1 is a belt pulley 13. A toothed belt 14 runs across the drive pulley 12 and the belt pulley 13. In-side the hollow shaft 15a is a drive shaft 18 at the top of which a cross-piece 20 is attached, whose ends carry the wall scrapers 19.

The hollow shaft 15a rotates in the stationary mixing container 5 at the angular velocity $\omega_P$. This angular velocity is twice as great as the angular velocity $\omega_S$ with which the drive shaft inside it is rotating around the container axis. To illustrate this, therefore, in FIG. 3 two arrows are drawn in for $\omega_P$ and only one arrow for $\omega_S$.

The drive is effected by a motor (not shown) in a similar way to that shown in FIG. 8, wherein an intermediate drive (not shown) is inserted between the motor shaft and the shafts 15a and 18, to supply the differing driving speeds.

Figure 13:
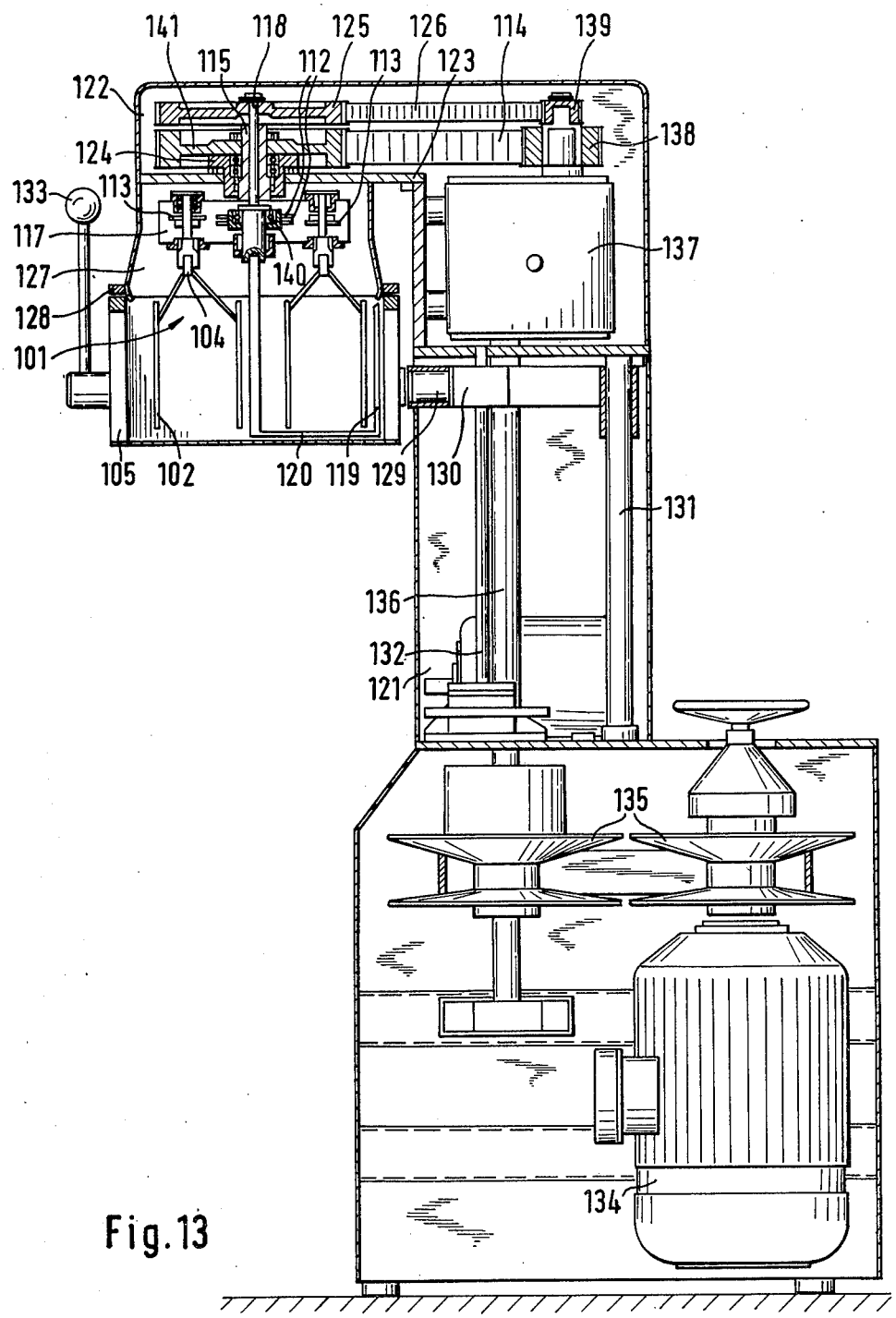
FIG. 13 shows a further embodiment of the invention in section.

A further embodiment of the invention, which includes a wall scraper, is shown in FIG. 13. In this, the drive of the mixing element and of the wall scraper is effected from above, i.e. the container has no tube through the center. At the upper end of a stand 121 which supports the entire mixer, a head 122 carrying the mixing elements is attached. Part of the head 122 is a horizontally extending carrier plate 123 in which a bearing bushing 124 is attached. In the bearing bushing 124 a hollow shaft 115 is mounted, at whose lower end, which projects forwardly out of the bearing bushing 124, an arm 117 is attached, in which the shafts 104 of two mixing elements 101 provided with rods 102 are rotatably mounted. At the upper end of the hollow shaft 115 a belt pulley 141 is attached round which the toothed belt 114 runs.

Extending through the hollow shaft 115 is a shaft 118 which runs through the arm 117 and at whose lower end an essentially L-shaped scraper is attached, said scraper having a vertical limb 119 and a horizontal limb 120. The free end of the horizontal limb 120 is connected to the shaft 118. At the upper end of the shaft 118 a pulley 125 is attached, round which runs a toothed belt 126.

The arm 117 is constructed as a hollow, box-like component. On those sections of the mixing element shafts 104 which run through the inside of the arm 117, each of them has a sprocket wheel 113, and attached to the corresponding section of the shaft 118, on an overrunning clutch hub 140, are two sprocket wheels 113. A chain belt (not shown) runs across each pair of sprocket wheels 112 and 113. The diameter of the sprocket wheels 112 is approximately twice that of the sprocket wheels 113.

The upper parts of the mixing elements 101 and the arm 117 are covered by a hood 127 open on the lower side, which is fixed to the carrier plate 123. The hood 127 has a flange ring 128 on the bottom edge which grips on the upper edge of a cylindrical mixing container 105 which is situated beneath the hood. The diameter of the mixing container 105 and the dimensions of the mixing elements coincide in such a way that the rods 102 of the mixing elements extend towards the wall of the container and towards the center of the mixing container, the vertical limb 119 of the scraper can scrape along the wall of the container and the horizontal limb 120 can scrape along the bottom of the container.

The mixing container is attached by means of a connecting piece 129 to a supporting member 130, which is mounted on a column 131 and a traversing screw 132 in the stand 121 and can be moved up and down when the traversing screw is turned. In a lowered position the mixing container 105 can be swung around the stand for emptying. For this procedure it can be held at the knob 133.

An electric motor is situated in the base of the stand for driving the mixing elements and the scrapers. This motor drives via an infinitely variable V-belt transmission 135, a shaft 136 and a reduction gear box 137 situated in the stand, two pulleys at the same speed across which the two toothed belts 114 and 126 run. The pulley 138 has a diameter of about twice the size of the diameter of the pulley 139, whereas the pulleys 141 and 125 have approximately the same diameter.

The mixer according to FIG. 13 works as follows: When the motor 134 is started, the two pulleys 141 and 125 turn at speeds with a ratio of about 2:1. The arm 117 which carries the mixing elements 101 thus rotates twice as fast as the scrapers 119, 120. In the one direction of rotation, clockwise for example, the overrunning clutch hub 140 automatically jams on the shaft 118 so that the sprocket wheels 112 rotate at the same speed as the scraper 119, 120. The chains (not portrayed) each running across one of the sprocket wheels 112 and one of the sprocket wheels 113 drive the shafts 104 of the mixing elements 101 in an opposite direction of rotation to the arm 117 during the rotation of said arm. As the shaft 118 only rotates half as fast as the arm 117 and the sprocket wheels 112 are twice as large as the sprocket wheels 113, the shafts 104 also rotate once within their bearings on the arm 117 during one single rotation of said arm. The speed ratios between the rotation of the arm 117 and of the mixing elements 101 are therefore the same as with the mixer according to FIGS. 6, 7 and 8.

As the scraper 119, 120 is only driven at half the speed of the arm 117, the velocity of impact of the mixing material on the scraper is as great as the velocity of impact of the material being mixed on the rods 102 of the mixing elements 101.

Figure 14:
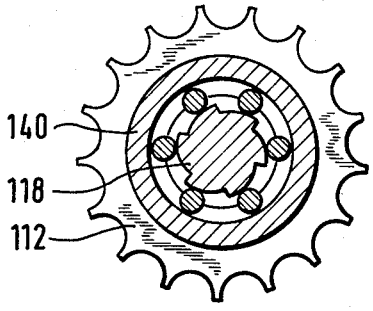
FIG. 14 shows an overrunning clutch which is used in the mixer according to FIG. 13.

If the direction of rotation of the motor 134 is reversed, the clutch connection with the overrunning clutch hub 140 is automatically released (see FIG. 14). A positive drive on the shafts 104 of the mixing elements 101 is then no longer present. During the movement of the mixing elements by the arm 117 through the mixing material, the mixing elements can turn freely on the arm 117. Their speeds of rotation can be automatically set according to the force extended on the rods by the mixing material.

The overrunning clutch used in the embodiment of the invention according to FIG. 13 is portrayed in detail in FIG. 14. Overrunning clutches of this type are well known making an explanation of the contents of FIG. 14 unnecessary. It may be pointed out however, that with the embodiment portrayed, one clockwise rotation of the sprocket wheel 112 and thus the hub 140, leads to a jamming of the hub 140 and thus activates the clutch which brings about the rotation of the shaft 118. It may also be pointed out that a counter clockwise rotation of the sprocket wheel releases the clutch.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A mixer comprising: a mix container, the interior of which is essentially symmetrical about a vertical axis; at least one rotatably symmetrical mixing element having a carrier plate and a plurality of mixing rods carried thereby and parallel to the axis of the mixing element, said mixing element being laterally offset from the axis of the mixing container and its axis forming an angle $\alpha$ with the axis of the container; the carrier plate being perpendicular to the axis of the element and the length of the rods being such that the rods extend adjacent to the walls and floor of the mix container; a drive shaft extending up through and coaxial with the container; a linkage assembly means rotatably connecting the element to said drive shaft; said linkage assembly means causing the mixing element to rotate in accordance with the relation $\omega_P \cdot \cos \alpha = \omega_M$ where $\omega_P$ is the angular velocity of the element about the container axis and $\omega_M$ is the angular velocity of the element about its own axis, and the direction of rotation of the element about the container axis is opposite to the direction of rotation of the element about its own axis.

2. A mixer comprising: a fixed mix container, the interior of which is essentially symmetrical about a vertical axis; at least one rotatably symmetrical mixing element having a plurality of mixing rods which are parallel to the axis of the mixing element, said mixing element axis being parallel to and laterally offset from the axis of the mixing container; carrier means; means rotatably mounting said mixing element on said carrier means for rotation about said mixing element axis and means rotatably mounting said carrier means for rotation about the container axis; means for rotating said carrier means about the container axis to move the mixing element in a planet-like movement about the axis of the mixing container; means, including said carrier means, for rotating the mixing element about its said axis as the carrier means rotates; the direction of rotation of the mixing element about the container axis being opposite to the direction of rotation of the element about its own axis, the angular velocities of the element corresponding to the relation $\omega_P = \omega_M$ where $\omega_P$ is the angular velocity of the element about the container axis and $\omega_M$ is the angular velocity of the element about the axis of the mixing element; at least one wall scraper; means rotatably mounting said wall scraper for rotation about the container axis; and said means for rotating said carrier and mixing element including means for rotating the wall scraper in the same direction as the rotational movement of the mixing element around the container axis with an angular velocity $\omega_S$, which does not exceed half of the angular velocity $\omega_P$ of the carrier means of the mixing element.

3. A mixer according to claim 2, wherein $\omega_S = \omega_P/2$.

4. A mixer according to claim 2, further comprising an overrunning clutch within the rotating means, said overrunning clutch being arranged so that in one rotating direction of said carrier means the clutch is coupling the means for rotating the mixing elements about their own axis, whereas in the reverse driving direction of said carrier means, the clutch is released, the mixing elements being freely rotatable about their own axes accordingly.

5. A mixer comprising: a fixed mix container, the interior of which is essential symmetrical about a vertical axis; at least one rotatably symmetrical mixing element having a plurality of mixing rods which are parallel to the axis of the mixing element, said mixing element axis being parallel to and laterally offset from the axis of the mixing container; carrier means; means rotatably mounting said mixing element on said carrier means for rotation about said mixing element axis and means rotatably mounting said carrier means for rotation about the container axis; means for rotating said carrier means about the container axis to move the mixing element in a planet-like movement about the axis of the mixing container; means, including said carrier means, for rotating the mixing element about its said axis as the carrier means rotates; the direction of rotation of the mixing element about the container axis being opposite to the direction of rotation of the element about its own axis, the angular velocities of the element corresponding to the relation $\omega_P = \omega_M$ where $\omega_P$ is the angular velocity of the element about the container axis and $\omega_M$ is the angular velocity of the element about the axis of the mixing element; an overrunning clutch within the rotating means, said overrunning clutch being arranged so that in one rotating direction of said carrier means the clutch is coupling the means for rotating the mixing elements about their own axis, whereas in the reverse rotating direction of said carrier means, the clutch is released, the mixing elements being freely rotatable about their own axes accordingly.

* * * * *